US007454853B2

(12) United States Patent
Taylor

(10) Patent No.: US 7,454,853 B2
(45) Date of Patent: Nov. 25, 2008

(54) VEHICULAR ANIMAL IDENTIFICATION PADDLE APPARATUS

(76) Inventor: Nancy M. Taylor, 4340 Rocky Shore Trail, Traverse City, MI (US) 49686

( * ) Notice: Subject to any disclaimer, the term of this patent is extended or adjusted under 35 U.S.C. 154(b) by 0 days.

(21) Appl. No.: 11/307,755

(22) Filed: Feb. 21, 2006

(65) Prior Publication Data

US 2007/0193093 A1 Aug. 23, 2007

(51) Int. Cl.
*G09F 21/04* (2006.01)

(52) U.S. Cl. ..... 40/591; 116/28 R; 116/173

(58) Field of Classification Search ..... 40/591; 116/28 R, 173
See application file for complete search history.

(56) References Cited

U.S. PATENT DOCUMENTS 4,519,153 A * 5/1985 Moon et al. ..... 40/591
4,582,017 A * 4/1986 Ostermiller ..... 116/28 R
4,590,883 A * 5/1986 Steed et al. ..... 116/173
D313,214 S * 12/1990 Phillips et al. ..... D12/223
5,233,938 A * 8/1993 Lalo ..... 116/173
D360,844 S * 8/1995 Miller et al. ..... D10/110
D398,028 S * 9/1998 Bennett ..... D20/41
D421,730 S * 3/2000 Vance ..... D11/166
2003/0172567 A1 * 9/2003 Zentner et al. ..... 40/591

* cited by examiner

*Primary Examiner*—Cassandra Davis
(74) *Attorney, Agent, or Firm*—Gregory T. Zalecki

(57) ABSTRACT

A vehicular animal identification paddle apparatus is comprised of a display member, a stem and a display member holder. The display member holder is comprised of a window clip , a horizontal extension member and a socket. The attachment means attaches the horizontal extension member and the socket to a vehicle window. The display member exhibits an animal identifier comprised of a silhouette of an animal and the printed name of that animal. The stem is attached at one end to the display member and at the other end secured to the socket. An animal of interest within a wildlife area is identified and exhibited to occupants of other vehicles by placing a coinciding display member within the apparatus and attaching it to a user's vehicle. This minimizes traffic congestion within the wildlife area and identifies the animal to those interested.

2 Claims, 3 Drawing Sheets

VEHICULAR ANIMAL IDENTIFICATION PADDLE APPARATUS

BACKGROUND

Many areas of the world are inhabited by wildlife. Often the wildlife consists of large animals. The areas may be served by roads. Good examples are national parks within the United States. Some national parks serve a large number of visitors on a daily basis. The visitors arrive and travel through such parks by motor vehicles. Typically, the roads are two-lane roads.

It is not unusual for a family traveling within an automobile on a road within a national park to have a family member spot a large animal, such as a bison, in land adjacent to the road. The driver of the vehicle will typically pull over to the side of the road to allow the vehicle occupants to view the animal. Other drivers driving on the same road see this and become curious. Their attention is drawn to the vehicle which has pulled to the side of the road. They too pull over because of the possibility that an animal which they or their passengers want to observe is in the area. Periodically, the drivers pull over to the side of the road after seeing another vehicle pull to the side of the road only to find that the animal being observed is not an animal of interest. This wastes the time of that driver and the driver's occupants as well as causes traffic congestion. Similarly, vehicles approaching the stopped vehicle from other directions, such as a head-on direction, react in the same way. They may pull over only to find that they are not observing an animal of interest. This problem becomes particularly egregious within national parks because national parks are usually served by only two-lane roads with minimal or no road shoulders. On busy park days traffic congestion caused by vehicles pulling over becomes a significant problem.

Traffic congestion is caused by all of the vehicles which pull over to the side of the road in response to an initial vehicle pulling over to the side of the road. These vehicles include vehicles containing occupants having an interest in the animal being observed. These vehicles also include vehicles containing occupants ultimately determining that the animal is not an animal of interest, and therefore the stop was unneeded. Traffic congestion is further exacerbated by the fact that many vehicles drive at a slow rate of speed while passing stopped vehicles in order to determine the point of interest. Additionally, other vehicles may drive past a particular animal of interest because the occupants do not learn the identity of that animal until they actually pass the stopped the vehicle.

There is a need for a device and a method for reducing traffic congestion within wildlife areas and for notifying occupants of approaching vehicles as to the type of animal spotted by an occupant of the stopped vehicle. An object of this invention is to identify spotted animals to approaching vehicles such that the drivers of those approaching vehicles have sufficient time to make a decision whether to stop or continue. This is accomplished by making the identity of an observed animal known to others from a distance which will minimize traffic congestion by allowing uninterested observers to continue driving, while allowing interested observers to stop and observe an animal of interest.

SUMMARY

A vehicular animal identification paddle apparatus is comprised of a display member, a stem and a display member holder. The display member holder is comprised of a window attachment means, a horizontal extension member and a socket.

The display member exhibits an animal identifier. The animal identifier identifies an observed animal. Preferably, the animal identifier is comprised of a silhouette of an animal and the printed name of that animal. The display member and the animal identifier should be of contrasting colors. The animal identifier should appear on two sides of the display member. The stem projects downwardly from the display member.

The window attachment means is adapted to attach the holder to a vehicle window. Preferably, the window attachment means is a clip for clamping the holder to a vehicle window. The window attachment means may also comprise a suction cup. The suction cup creates a suction attachment to a vehicle window.

The horizontal extension member extends from the window attachment means. It spaces the display member apart from a vehicle window. It may attach to a vertical support section of the window attachment means. The window attachment means, the horizontal extension member and the socket are configured to avoid mechanical interference with any nearby side mirror of the vehicle to which those parts are attached. Those parts are also configured to avoid interference with a vehicle driver's line of sight through the mirror.

The socket is attached to the distal end of the horizontal extension member. The distal end of the horizontal extension member is the end opposite to the end of the horizontal extension member which attaches to the window attachment means. The socket is adapted to securely hold the stem. This may be accomplished by configuring the socket with a slot shaped to firmly hold the stem.

In order to use the vehicular animal identification paddle apparatus a display member having a desired animal identifier is attached to the display member holder by inserting the stem into the socket. The display member holder is attached to a window of a motor vehicle.

The vehicular animal identification paddle apparatus is used to reduce traffic congestion within a wildlife area and for directing attention of others to animals of interest. This is accomplished by the following steps. A person positioned within a vehicle enters a wildlife area containing animals by driving the vehicle into that area. An animal of interest is identified. The vehicle is stopped. A vehicular animal identification paddle apparatus is selected. The animal identifier coincides with the animal of interest. The display member exhibiting the animal of interest is inserted into the socket of the display holder. The display holder is attached to a window of the vehicle. As a result, vehicles approaching from the rear containing occupants having no interest in the identified animal may pass by, thereby reducing traffic congestion. Vehicles approaching from the rear containing occupants having an interest in the identified animal may stop and observe the animal.

DRAWINGS

These and other features, aspects, and advantages of the present invention will become better understood with regard to the following description, appended claims, and accompanying drawings where:

DESCRIPTION

Figure 1:
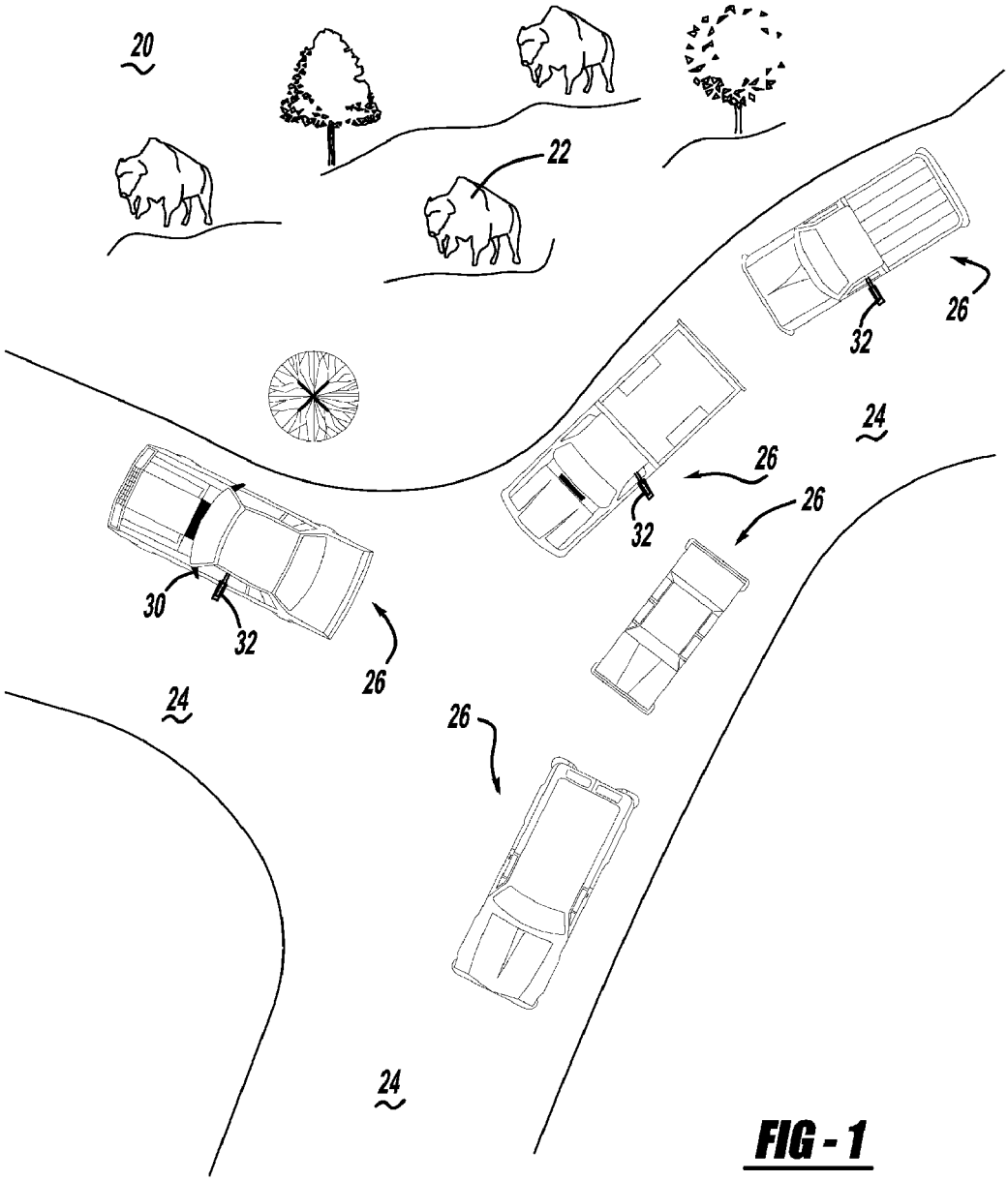
FIG. 1 is a perspective view showing vehicles equipped with vehicular animal identification paddle apparatus within a wildlife area.

A vehicle animal identification paddle apparatus 32 is optimally used within a national park. A part of a national park is shown in FIG. 1. The national park contains a wildlife area 20. The wildlife area 20 is inhabited by large animals 22. National park visitors have a significant interest in observing large animals 22 roaming the wildlife area 20. The wildlife areas 20 of national parks are accessible by roads 24.

Figure 2:
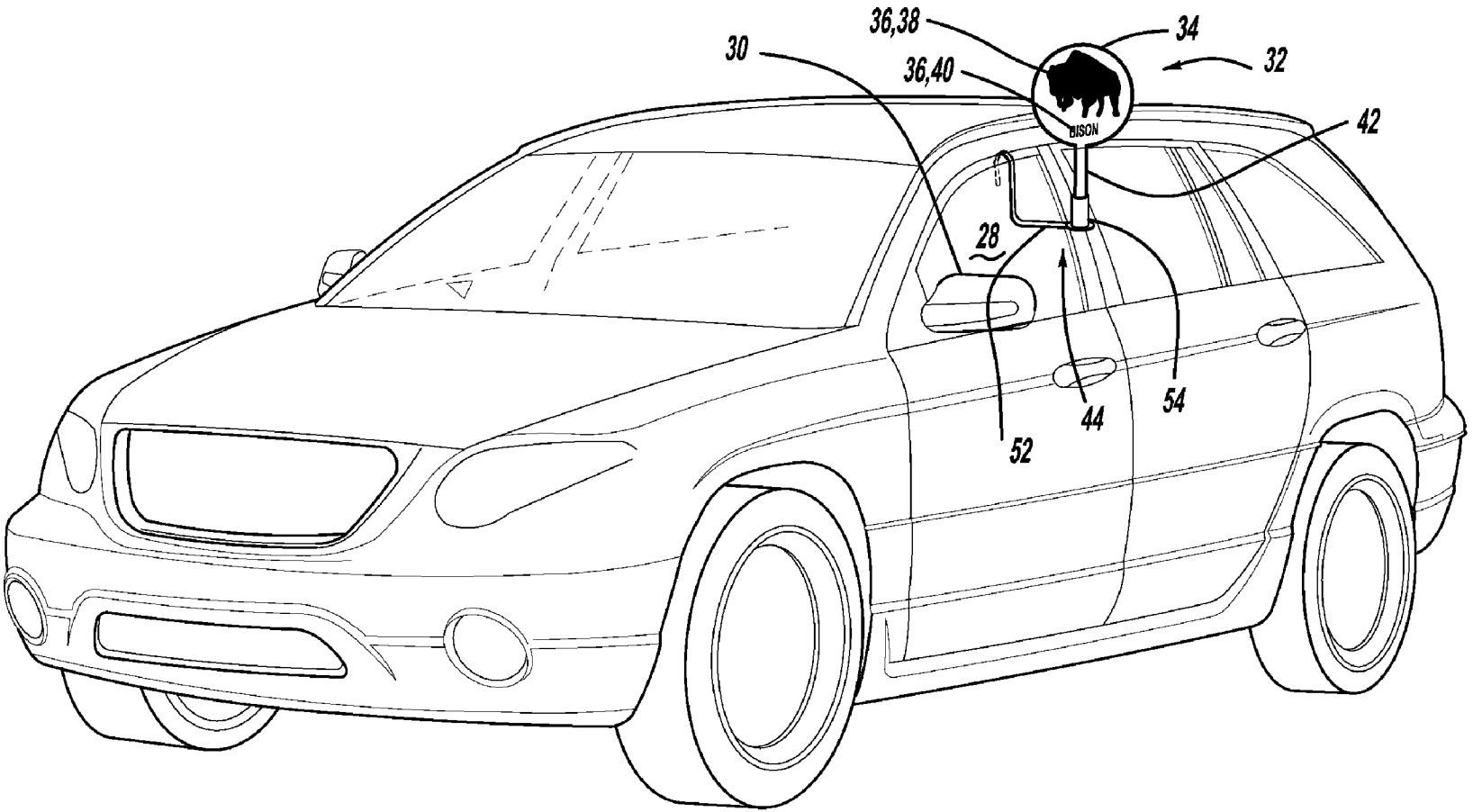
FIG. 2 is a perspective view of a vehicle having a vehicular animal identification paddle apparatus attached to a window.

FIG. 1 shows a number of vehicles 26 positioned upon roads 24 within a national park. The vehicles 26 contain national park visitors. The vehicles 26 shown are equipped with vehicle animal identification paddle apparatus 32. One of the vehicles shown in FIG. 1 is enlarged and shown in FIG. 2. That vehicle 26 has a driver's window 28. The vehicle 26 is also equipped with a side mirror 30. FIG. 2 shows the vehicular animal identification paddle apparatus 32 clipped onto the driver's window 28 of the vehicle 26 while the window 28 is in the up position. Note that the vehicle animal identification paddle apparatus 32 does not mechanically interfere with the mirror 30. Additionally, it does not interfere with the driver's line of sight through the mirror 30. The vehicle animal identification paddle apparatus 32 may also be attached to the window 28 while the window is partially lowered. The vehicle animal identification paddle apparatus 32 is configured to avoid mechanical and visual interference with the mirror 30 when the window 28 is partially lowered.

A vehicular animal identification paddle apparatus 32 is comprised of a display member 34, a stem 42 and a display member holder 44. The display member holder 44 is comprised of a window attachment means 46, a horizontal extension member 52 and a socket 54. These parts are shown in FIG. 3.

The display member 34 and the stem 42 should be fabricated from plastic. The display member 34 should be circular and approximately 9 inches in diameter. Other geometric configurations of the display member 34 may also be used. The display member 34 exhibits an animal identifier 36. Preferably, the animal identifier 36 comprises the silhouette 38 of an animal and the printed name 40 of that animal. It is anticipated that the vehicle animal identification paddle apparatus 32 will be used with a number of different display members 34. The wildlife area 20 typically contains multiple species of animals 22. Display members 34 each exhibiting a different animal should be available to the occupants of a vehicle. The display member 34 and the animal identifier 36 should be of contrasting colors. Preferably, the display member 34 is white in color, while the animal identifier 36, including the silhouette 38 of the animal and the printed name 40 of the animal, are black. This will provide optimal visual communication to occupants of other vehicles 26 on the road 24. In other words, the contrasting colors between the display member 34 and the animal identifier 36 optimize the ability of other vehicle occupants to recognize the animal 22 identified by the animal identifier 36 from a distance. A solid black color should be, but is not required to be, used within the silhouette 38 exhibited on the display member 34. The animal identifier 36 may be imprinted or painted upon the display member 34. It may also be applied to the display member 34 as a sticker or a decal. The animal identifier 36 should appear on two sides of the display member 34. In this way the animal identifier 36 will be visible to vehicles approaching from the rear of the user's vehicle, as well as by vehicles approaching from the front.

Figure 3:
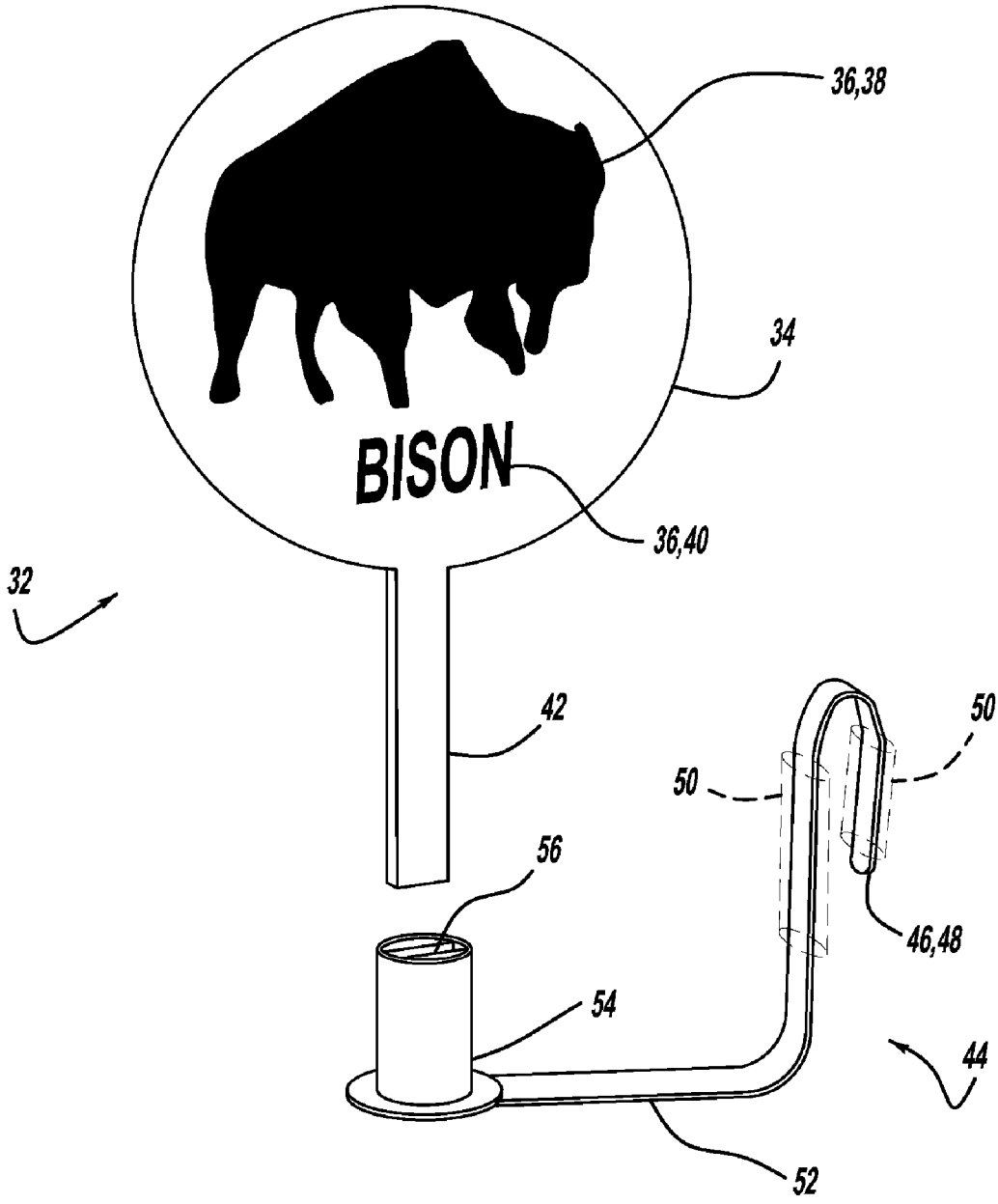
FIG. 3 is an elevation view of the display member, stem and display member holder of the vehicular animal identification paddle apparatus shown in FIG. 2.

The stem 42 projects downward from the display member 34 when the animal identifier 36 is oriented horizontally, as shown in FIG. 2 and FIG. 3. The stem 42 is shaped and sized to securely fit within the socket 54. To accomplish this stems 42 with round cross sections should be avoided. Stems 42 having round cross sections are more difficult to secure within a socket 54. The stem should have a rectangular, square, hexagonal or other polygonal cross-section. This will allow the socket 54 to be adapted to securely hold the stem 42.

The display member holder 44 is attachable to a vehicle window 28 by the window attachment means 46. Preferably, the window attachment means 46 is a clip 48. The clip 48 securely attaches to the window 28. The parts of the clip 48 coming into contact with the window 28 should be protected by a resilient enclosure 50. The resilient enclosure 50 may be foam, rubber or a similar material. The resilient enclosure 50 protects the vehicle window 28 from being scratched by the clip 48. The resilient enclosure 50 also enhances the gripping function of the clip 48. Alternatively, other window attachment means 46 may be used. This includes a suction cup for creating a suction attachment to the vehicle window 28.

The horizontal extension member 52 extends from the window attachment means 46. When the window attachment means 46 is a clip 48, the clip 48 includes a vertical support extending from the clip 48 toward the horizontal extension member 52. The purpose of the vertical support section of the clip 48 is to space the horizontal extension member 52 downwardly from the top of the window 28, as shown in FIG. 2. Optimal vertical spacing from the apex of the clip 48 is approximately 6 inches. The optimal length of the horizontal extension member 52 is approximately 6 inches. The horizontal extension member 52 spaces the socket 54 away from the vehicle window 28.

The socket 54 is attached to the distal end of the horizontal extension member 52. This is the end of the horizontal extension member 52 which is furthest from the window attachment means 46. Preferably, the socket 54 has a height of approximately 2 inches. The socket 54 is adapted to securely hold the stem 42. This is accomplished by fabricating the socket 54 with a recess, such as a slot 56, which securely mates with the stem 42 such that the stem 42 is inhibited from turning within the socket 54 and is inhibited from being easily removed from the socket. The recess of the slot 56 may also be rectangular, square, hexagonal or polygonal if that configuration matches the cross-section of the stem 42 such that the stem 42 is secured to the socket 54.

The window attachment means 46, the horizontal extension member 52 and the socket 54 should be fabricated from a rigid material. This includes plastic and malleable metal. The window attachment means 46, the horizontal extension member 52, the socket 54, the display member 34 and the stem 42 are configured to avoid mechanical interference with the side mirror 30 of the vehicle 26 upon which the apparatus 32 is to be mounted. The window attachment means 46, the horizontal extension member 52, the socket 54, the display member 34 and the stem 42 are also configured to avoid interference with a vehicle driver's line of sight through the mirror 30 when the apparatus 32 is mounted to a vehicle 26. The configuration is also such that mechanical and visual interference is avoided when the apparatus is mounted to a vehicle window 28 which is in a partially down position.

The vehicular animal identification paddle apparatus 32 is used to reduce traffic congestion within a wildlife area 20 and to direct attention to animals 22 of interest. To use the apparatus 32 a person positioned within a vehicle 26 enters a wildlife area 20 containing animals 22. The entry is accomplished by driving the vehicle 26 on a road 24 within the wildlife area 20. An animal 22 of interest is identified. For example, an occupant of the vehicle 26 may have identified a bison 22 as an animal 22 of interest. Once the animal 22 of interest is identified a vehicular animal identification paddle apparatus 32 is selected. The animal identifier 36 of the display member 34 selected identifies the animal 22 of interest. In other words if the animal 22 of interest is a bison, the animal identifier 36 will depict a bison. The silhouette 38 is the silhouette of a bison. The printed name 40 appearing on the display member 34 exhibits the word "BISON." The stem of 42 of the selected display member 34 is positioned within the socket 54. The vehicular animal identification paddle apparatus 32 is attached to a window 28 of the vehicle 26. Preferably, the vehicle 26 is stopped at the side of the road 24.

When the vehicular animal identification paddle apparatus 32 is used as described approaching vehicles containing occupants having no interest in the identified animal 22 may pass by. This reduces traffic congestion. Approaching vehicles containing occupants having an interest in the identified animal 22 may stop and observe the animal 22.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions and methods insofar as they do not depart from the spirit and scope of the present invention.

What is claimed is:

1. A method for reducing traffic congestion within a wildlife area and for directing attention to animals of interest, said method comprising:

entering a wildlife area containing animals while positioned within a vehicle;

identifying an animal of interest;

selecting a vehicular animal identification paddle apparatus comprising:

a display member exhibiting an animal identifier;

a stem projecting downwardly from the display member; and a display member holder comprising:

a window attachment means for attaching the holder to a vehicle window;

a horizontal extension member extending from the window attachment means for spacing the display member apart from a vehicle window; and a socket attached to the distal end of the horizontal extension member, said socket being adapted to securely hold the stem;

the stem being positioned within the socket; and wherein the animal identifier of the display member identifies the identified animal of interest;

attaching the vehicular animal identification paddle apparatus to a window of the vehicle;

whereby vehicles approaching containing occupants having no interest in the identified animal may pass by, thereby reducing traffic congestion; and whereby vehicles approaching containing occupants having an interest in the identified animal may stop and observe the animal.

2. The method for reducing traffic congestion within a wildlife area and for directing attention to animals of interest of claim 1 further comprising stopping the vehicle.

* * * * *